United States Patent [19]

Wahlstrom et al.

[11] Patent Number: 4,617,868

[45] Date of Patent: Oct. 21, 1986

[54] RAILROAD HOPPER CAR WITH SELF-CONTAINED DISCHARGE SYSTEM

[75] Inventors: Merle D. Wahlstrom, South Holland; Brian T. Votaw, Aurora, both of Ill.

[73] Assignee: Miner Enterprises, Inc., Geneva, Ill.

[21] Appl. No.: 680,196

[22] Filed: Dec. 10, 1984

[51] Int. Cl.[4] ..... B61D 7/20; B61D 7/22

[52] U.S. Cl. ..... 105/282 A; 105/282 P; 105/305; 222/545; 298/27

[58] Field of Search ..... 105/247–253, 105/280, 282 A, 282 R, 282 P, 305, 308 A; 222/476, 545; 298/24, 27

[56] References Cited

U.S. PATENT DOCUMENTS

| | | | |
|---|---|---|---|
| 729,266 | 5/1903 | Brenzinger | 298/27 |
| 1,488,229 | 3/1924 | Burns | 105/247 |
| 2,079,862 | 5/1937 | Kiesel, Jr. | 105/247 X |
| 2,914,000 | 11/1959 | Mulrahy | 105/280 |
| 2,926,962 | 3/1960 | Dorey | 105/280 X |
| 3,009,607 | 11/1961 | Sayre | 105/248 X |
| 3,127,851 | 4/1964 | Auksel | 105/248 |
| 3,332,363 | 6/1967 | Becker | 222/545 X |

FOREIGN PATENT DOCUMENTS

| | | | |
|---|---|---|---|
| 649619 | 10/1962 | Canada | 105/247 |

*Primary Examiner*—Randolph Reese
*Assistant Examiner*—Glenn B. Foster

[57] ABSTRACT

A railroad hopper car particularly adapted for shipment of dry, granular-like commodities may have its inner space divided into compartments which in turn are formed with chambers. Each chamber bottom includes a discharge system comprising a pair of aligned fluidizing conveyors which converge downward. Lower ends of the conveyors are spaced apart to define a chute outlet which includes a passageway through a chute portion of a slide gate discharge assembly. The passageway may be closed or opened by selective movement of a door plate connecting with a drive mechanism in a drive portion of the assembly. Commodity in the railroad car is maintained contamination free in part by isolating the chute and drive portion with seals that engage the door plate and a sanitary plate which pivots to close the passageway lower end. During commodity unloading the sanitary plate and door plate are located to clear the passageway through the chute outlet. Additionally, pressurized air is supplied to the conveyors to substantially aerate commodity in and about the chute outlet to enhance its discharge through the chute for delivery external of the car.

3 Claims, 10 Drawing Figures

RAILROAD HOPPER CAR WITH SELF-CONTAINED DISCHARGE SYSTEM

BACKGROUND OF THE INVENTION

1. Field of the Invention

This invention relates to railroad hopper cars for shipment of a dry granular commodity and particularly to cars having an effective self-contained discharge system, for example fluidizing conveyors in combination with a slide gate discharge assembly which also inhibits contamination of the commodity during shipment and discharge.

2. Prior Art

Use of self-contained unloading devices in a vehicle for transporting bulk commodities is well known. For example, U.S. Pat. No. 2,609,125 discloses a transportable bin with a pair of air activated conveyors to promote unloading of commodity in the bin.

A railroad car with a self-contained unloading device and associated outlet with a closing mechanism is set forth in U.S. Pat. No. 2,789,739. In this case the outlet may be closed or opened by rotation of an arcuate closure plate attached by webs to a hub on a shaft. A gate assembly for use as part of a railroad hopper car outlet is shown in U.S. Pat. No. 2,751,859. The assembly includes a gate having side rack teeth engaging a pinion gear on a handle operated shaft. The gate may be retracted into an enclosable shroud to open the car outlet. The underside of the gate is protected by a cover plate during shipment which then is removed before the car is emptied.

Railroad hopper cars with substantially more sophisticated self-contained unloading means are shown in U.S. Pat. Nos. 3,379,478, 3,469,888 and 4,440,528. In each case a rather elaborate piping arrangement is used to supply a flow of air selectively to a pressurized car body. For example, in the '478 patent air flows through bottom fluidizing conveyors in the car to a top sump where it is then piped downward to a horizontal unloading tube. Air flowing in this tube draws commodity up a downward facing conduit in a bottom sump in the car. In the '888 reference the hopper car bottom has two pairs of fluidizing conveyor troughs. An air flow is alternated to these conveyor troughs to produce like aeration of commodity above the conveyor troughs. The '528 reference also teaches the use of alternating aeration but suggests a different piping arrangement to achieve this result.

SUMMARY OF THE INVENTION

A railroad car with a hopper-type body has proved particularly useful for bulk shipment of a dry granular or powdered commodity, for example flour. To facilitate an unloading of the commodity the car body may be divided into compartments which in turn are divided into chambers. Each chamber in turn may have sloped side and end walls which connect with a self-contained commodity discharge system.

The discharge system comprises a pair of aligned fluidizing conveyors which form a bottom of the chamber. The conveyors slope downward to a middle of the chamber with a lower end of each spaced apart to define a chute outlet. Each conveyor has a panel-like body which includes a support plate for a sheet of permeable media. Edges of the media sheet extend onto flanges of the conveyor body where they are held between like flanges on the chamber walls.

The chute outlet connects with a passageway through a chute portion of a slide gate discharge assembly. The assembly further includes a door plate which in an advanced position engages slide bars attached about the passageway. In this advanced position the door plate closes the passageway.

An inner end of the door plate extends through a narrow opening in the chute portion and into a drive portion of the assembly. In the drive portion is an operative mechanism which connects with an inner end of the door plate. The chute portion is isolated from the drive portion by seals which engage surfaces of the door plate. The assembly additionally includes a pair of sanitary plates. One plate is positioned over a lower end of the chute portion passageway while the other plate is positioned to close the assembly drive portion. Each plate is pivotally attached so that the passageway may be selectively uncovered or access provided to the operative mechanism respectively.

During shipment of the commodity the door plate of the discharge assembly is advanced and the chute portion sanitary plate positioned to cover the chute lower end. During unloading of a chamber upon arrival of the hopper car at its destination, the chute portion sanitary plate is released and rotated to open the lower end of the gate assembly chute portion passageway. Next an air flow is introduced into each conveyor body through an inlet centrally located therein. A substantial portion of each air flow is directed to the conveyor lower end with a remainder to upper ends of the conveyors. The air flows through the permeable media sheets to produce substantial aeration of the commodity about the chute outlet. The operative mechanism in the assembly then is activated to retract the assembly door plate to begin a flow of commodity through the outlet and passageway for delivery external of the car. Commodity continues to discharge until the chamber is empty.

The self-contained railroad hopper car discharge system of this invention provides several advantages over those presently known or in use.

First, commodity quality as loaded into the hopper car is not affected during shipment since the chute portion sanitary plate and sealed door plate inhibit contact between the commodity and environmental contaminants about the car. The door plate readily seats on the chute portion slide bars, and the assembly chute portion and drive portion are isolated by engagement of the seals with the door plate surfaces. This isolation of the assembly portions continues during unloading preventing contact between any contaminant in the assembly drive portion and commodity flowing through the assembly chute portion.

Next, movement of the commodity to the chute outlet is particularly enhanced by increasing the degree of aeration by the fluidizing conveyors of commodity immediately adjacent to the chute outlet. Note that after transit the commodity about the chute outlet typically is in a more compacted state than commodity in upper portions of the car chamber, for example. Obtaining initial aeration and subsequent movement of this more compacted commodity is most important if the discharge system is to be relatively simple and at the same time operate reliably.

Further, the discharge system of this invention may be readily cleaned as routinely required after the hopper car has been unloaded. Additionally, the system may be more thoroughly sanitized as is periodically necessary. In this latter case some disassembly of the system may be required and include the assembly drive portion which is readily accessible. The chute outlet and included assembly passageway are sufficient in size to allow manipulation of a high pressure air blowout nozzle to dislodge remnants of the commodity. Additionally, the defining surfaces of the system are relatively unobstructed. Thus, difficult-to-reach pockets of inadvertent commodity accumulation are minimized.

Lastly, the system may be easily incorporated in new hopper cars and installed in existing ones. Note that the discharge system works effectively in a non-pressurized car body. Therefore, the car body need not be made as a pressure vessel. Thus, the overall cost of the car may be reduced by using a light weight car body design with this simplified discharge system.

DESCRIPTION OF THE PREFERRED EMBODIMENT

Figure 1:
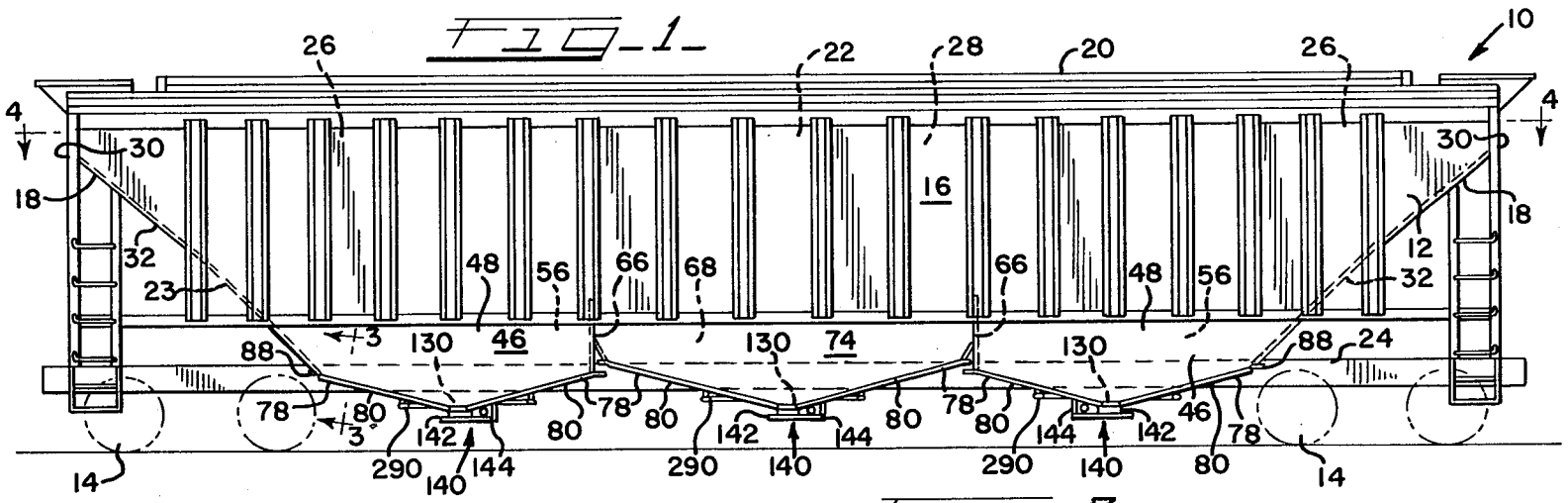
FIG. 1 is a side elevation view of a typical railroad hopper car.
Figure 2:
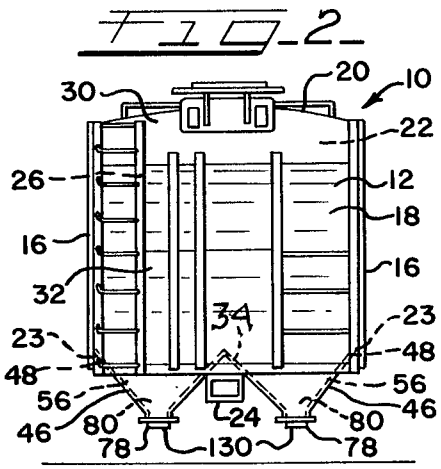
FIG. 2 is an end elevation view of a body portion of the hopper car of FIG. 1.

A railroad hopper car is shown generally in FIGS. 1 and 2 and designated 10. The car 10 has a body portion 12 carried by a pair of spaced trucks 14. The car body 12 includes sidewalls 16, ends 18, and a roof 20 to define an interior space 22. Extending longitudinally in a lower portion 23 the car body 12 is a center sill 24 which connects with the trucks 14 and carries at each end a coupler system (not shown).

Figure 3:
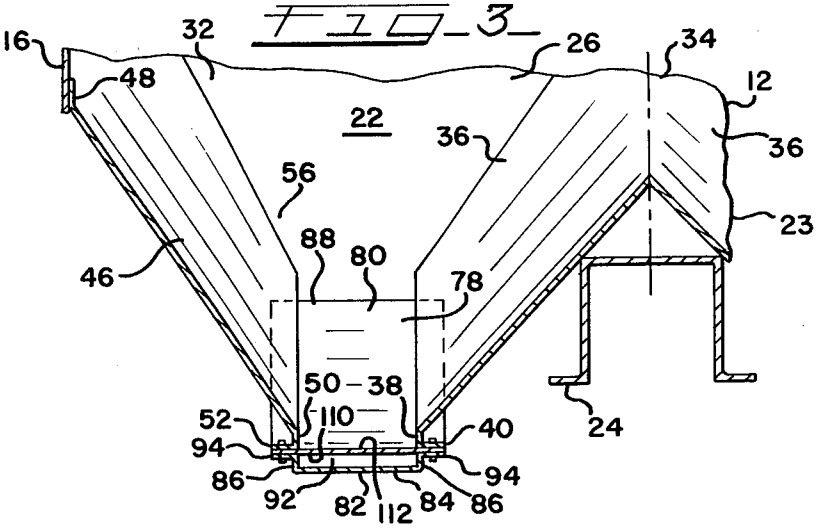
FIG. 3 is a section view through one compartment of the hopper car as seen generally along the line 3—3 of FIG. 1.
Figure 4:
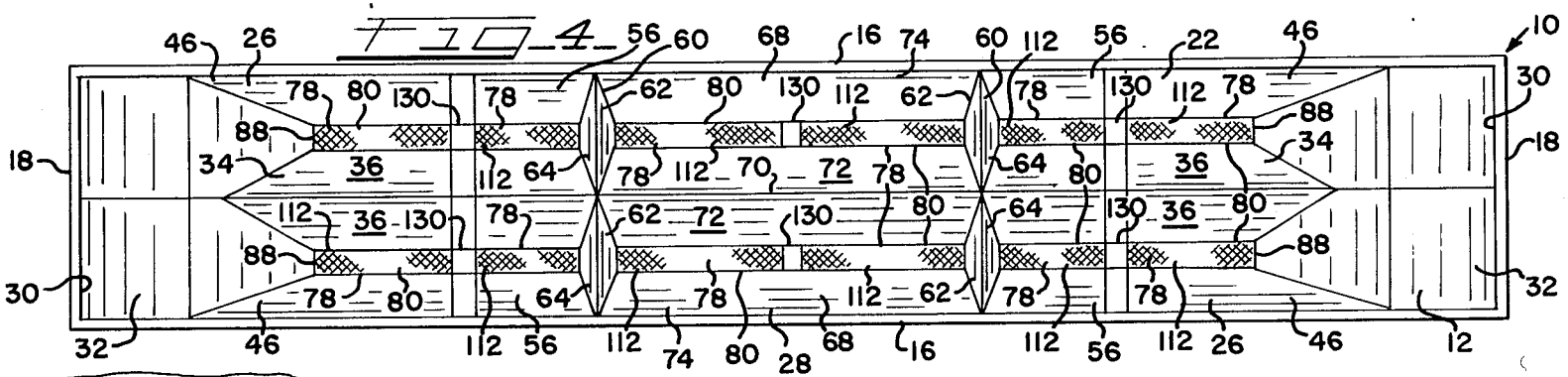
FIG. 4 is a section view as seen generally along the line 4—4 of FIG. 1.

As best understood by viewing FIGS. 1 and 4 the hopper car interior space 22 is divided into three compartments, two end compartments 26 and a center compartment 28. The end compartments 26 are defined in part by the car ends 18 which further include an upper vertical end sheet 30 connecting with lower sloped end sheet 32. Each sloped end sheet 32 extends downward to connect with an inverted V-shaped deflector panel 34 in a center of each end compartment 26, see FIGS. 3 and 4. These panels 34 are supported by the sill 24. Each end deflector panel 34 comprises a pair of outward sloped inner side sheets 36. A bottom portion of each inner side sheet 36 connects with a pair of vertical inner elongated segments 38. Connecting with each vertical segment 38 is an inner extending flange 40, see FIGS. 3 and 8. The elongated segments 38 and flanges 40 slope downward toward a middle of each inner side sheet 36 where lower ends 42 of each terminate and join an inner connecting chute segment 44.

The sloped end sheet 32 also connects with a pair of sloped outer side sheets 46 having an upper portion 48 joined to the car body sidewalls 16 respectively. A lower portion of each sloped outer side sheet 46 likewise connects with a pair of vertical outer elongated segments 50 which in turn are formed with outwardly extending flanges 52, see FIGS. 3 and 8. The elongated segments 50 and flanges 52 slope downward toward a middle of each outer side sheets 46 where lower ends 54 of each terminate and join an outer connecting chute segment 55. The inner and outer side sheets 36, 46 of the end compartments 26 define in part two pairs of end chambers 56.

Each end compartment 26 may be separated from the center compartment 28 by an inverted V-shaped crossridge panel 60 which extends laterally between the car sidewalls 16. Each crossridge panel 60 has one pair of sloped inner end sheets 62 and a like pair of outer end sheets 64, see FIG. 4. Alternately, the compartments 26, 28 may be separated respectively by a vertical partition 66, see FIG. 5.

The center compartment 28 is constructed in a similar manner to the end compartments 26 and includes a pair of longitudinal chambers 68. These center compartment chambers 68 are defined by a like inverted V-shaped deflector panel 70 having sloped inner side sheets 72 and outer side sheets 74. The panel 70 is likewise carried by the center sill 24, and the sloped outer side sheets 74 connect with the car body sidewalls 16. It should be understood these sheets 72, 74 also are each formed with a pair of elongated segments, flanges and connecting chute segment but these are not specifically shown.

In each end chamber 56 and center chamber 68 is a pair of aligned fluidizing conveyors 78. Construction of each of these conveyors 78 is substantially the same and therefore like reference numbers are used to identify similar structure. Note that because the center compartment 28 may be somewhat larger than the end compartments 26, the conveyors 78 for the center chambers 68 would have a correspondingly increased length.

Each pair of conveyors 78 in the respective chambers 56, 68 is positioned between the elongated segments of the sloped inner and outer sheets, for example between the elongated segments 38, 50 of the end compartment sloped inner and outer side sheets 36, 46. Each conveyor pair 78 in part forms a bottom 80 of each chamber 56, 68 with the conveyors 78 of each pair sloping downward toward a center of each chamber 56, 68, see FIGS. 5 and 6.

Figure 5:
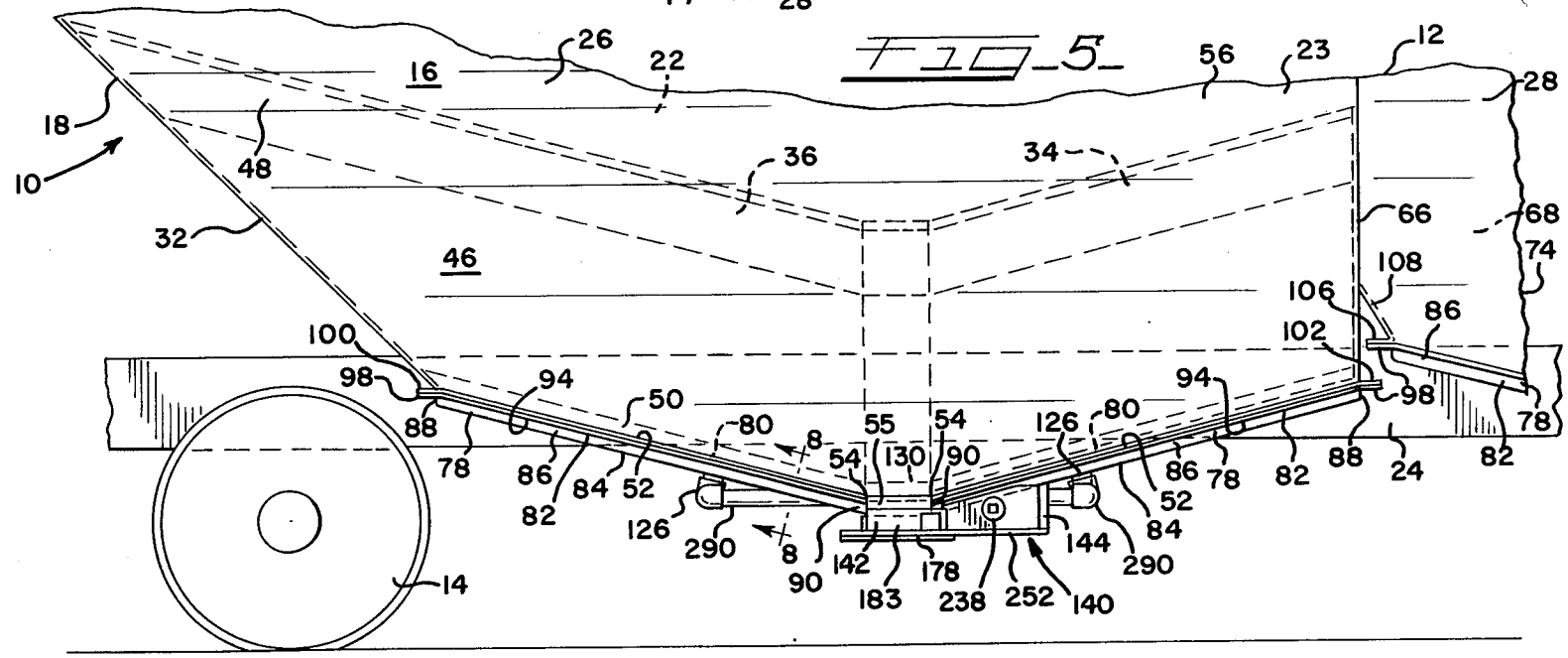
FIG. 5 is a side elevation view of a lower portion of an end compartment of the hopper car of FIG. 1.
Figures 6, 7, 8:
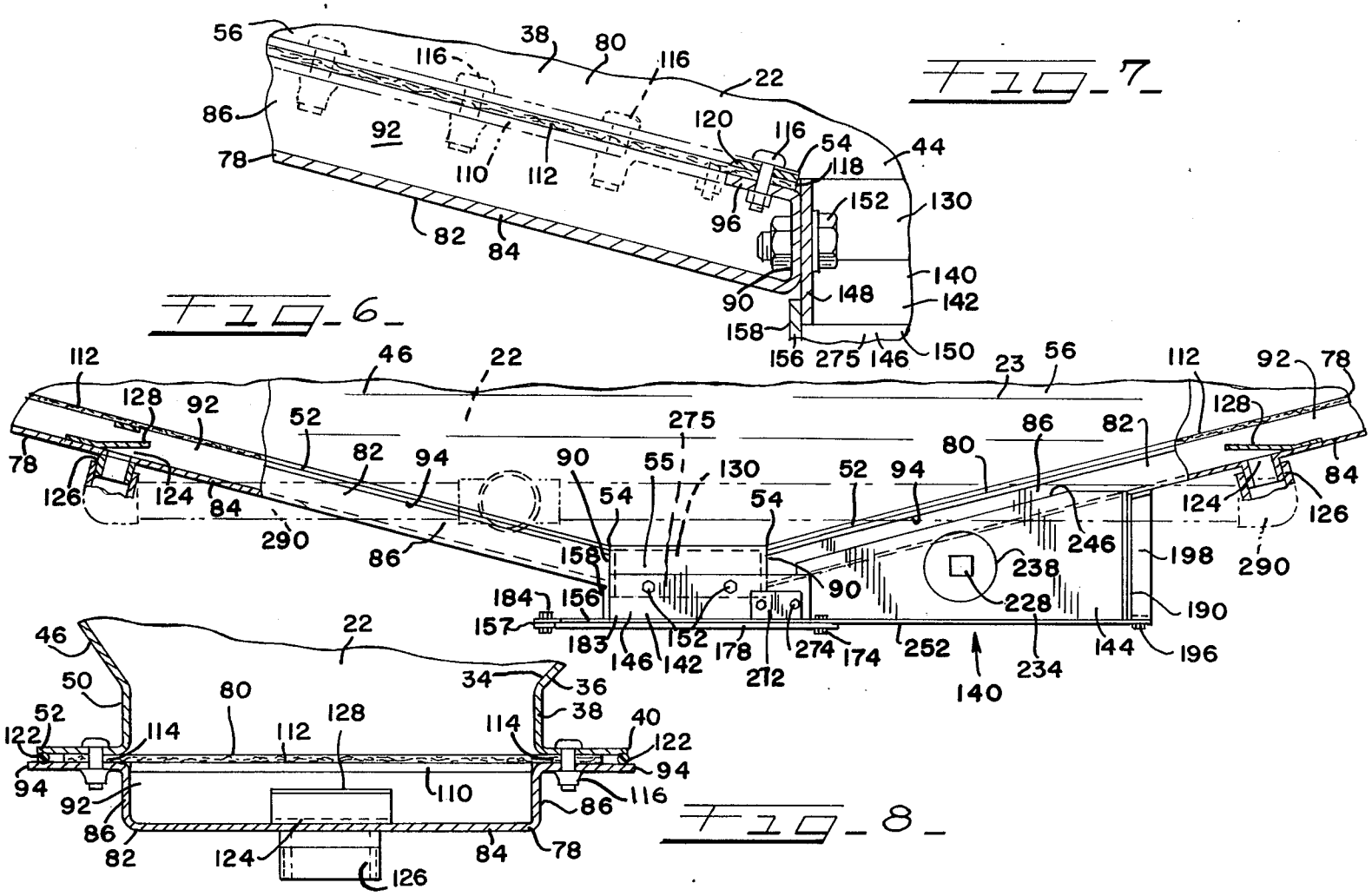
FIG. 6 is a more detailed side elevation view partially in section of the hopper car compartment wherein a fluidizing conveyor and a slide gate discharge assembly form part of a hopper car commodity discharge system of this invention.
FIG. 7 is a detailed side elevation view in section showing a lower end of the fluidizing conveyor connecting with a chute outlet of the railroad car.
FIG. 8 is an elevation view in section as seen generally along the line 8—8 of FIG. 5.

The conveyor 78 has a panel-like body 82 defined by a bottom wall 84 joined by spaced apart sidewalls 86, and upper end 88 and lower end 90, see FIGS. 5–7, to define a plenum space 92. Connecting with each sidewall 86 is an inner and outer side attaching flange 94, see FIGS. 3 and 8. These side flanges are positioned to align with the side sheet flanges 40, 52. Connecting with the lower end 90 is an angularly offset, inward extending attaching flange 96 while a further attaching flange 98 projects from the upper end 88. This upper end flange 98 aligns with a like flange 100 formed on the lower sloped end sheet 32 and a further flange 102 formed as of the partition 66, for example. As seen in FIG. 5, the upper end flange 98 of each conveyor 78 for the center 28 is positioned above the like flange 98 of each conveyor 78 for the end compartments 26 because of the increased length of the center compartment conveyors 78. The upper end attaching flange 98 on the center compartment conveyors 78 may connect with an inner member 106 of a bracket 108 attached to the partition 66.

As best seen in FIG. 8, wedged between the conveyor panel sidewalls 86 and extending from the lower end flange 96 to the upper end 88 is a perforated media support plate 110. On the support plate 110 is a sheet 112 of air permeable media. Edges 114 of the media sheet 112 extend over the conveyor panel sde flanges 94 where the edges 114 are compressively held against the sheet side flanges 40, 52 by fasteners 116 assembled to the flanges 40, 52 and 94. A lower end edge 118 of the media sheet 112 is compressively held between a plate 120 and the conveyor panel lower end flange 96 by further fasteners 116. While not shown in detail an upper edge of the media sheet 112 is held in a like manner by the conveyor panel upper end flange 98 and respectively by the sloped end sheet flange 100, the partition flange 102, of the bracket inner member 106. As seen in FIG. 8, a bead 122 of a butyl caulking may be applied adjacent to media sheet edges, for example side edges 114 and between the respective flanges to seal these edges.

As best seen in FIGS. 6 and 8, the bottom wall 84 of each conveyor body 82 at its proximate midpoint is formed with an opening 124. Joined to an outside of each of these openings 124 is a coupling 126 while positioned in the conveyor plenum 92 and above each opening 124 is a deflector plate 128.

The lower ends 90 of each pair of conveyors 78 in the chambers 56, 68 are spaced apart to define in part a chute outlet 130 in each chamber 56, 68. A slide gate discharge assembly 140 forms a further part of each outlet 130. As seen generally in FIG. 1 and shown in greater detail in FIGS. 5, 6, 9 and 10, each assembly 140 includes a chute portion 142 and a drive portion 144. The drive portion 144 of the assemblies 140 associated with the end compartments 26 are positioned on an opposite side of the chute outlet 130 than the car trucks 14. The assemblies 140 associated with the chute outlets 130 for the center compartment chambers 68 may have the drive portion 144 positioned on either side since access to the drive portion 144 is not affected by the trucks 14.

All of the assemblies 140 are substantially the same in construction and therefore only one is shown and described in detail. The assembly 140 shown and described is associated with the end chamber 56 seen in FIG. 5. While the terms "inner" and "outer" are used to aid describing various elements of the assembly 140, it should be understood that assembly 140 in and of itself does not have an "inner" or "outer" end except as assembled to a particular chute outlet 130.

Figures 9, 10:
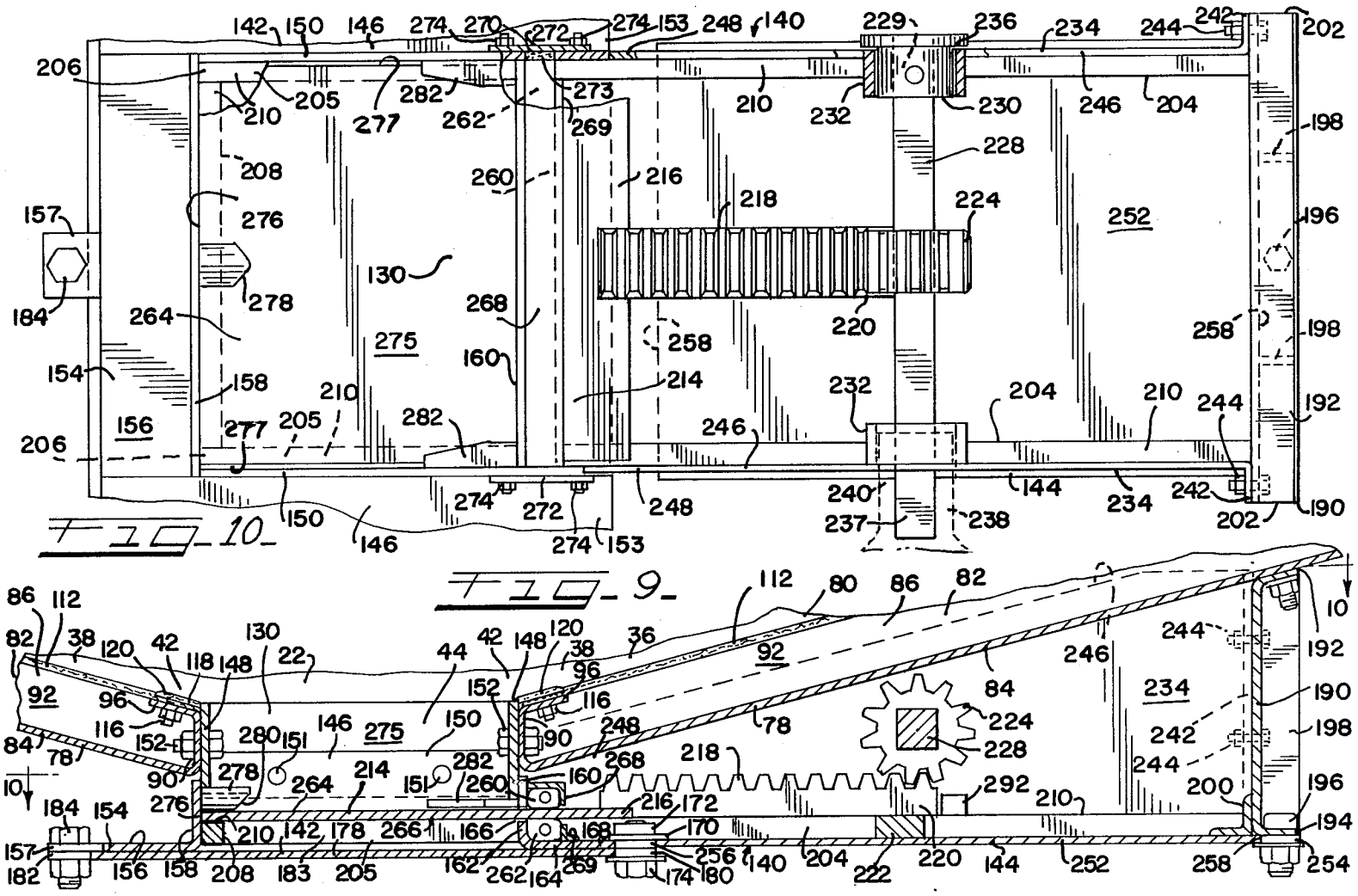
FIG. 9 is a detailed side elevation view in section showing the slide gate discharge assembly connecting with the car chute outlet and fluidizing conveyors.
FIG. 10 is a plan view partial in section as seen generally along the line 10—10 of FIG. 9.

As shown in detail in FIGS. 9 and 10 assembly chute portion 144 includes a pair of spaced side frame angles 146 connecting with a pair of spaced apart end plates 148. A vertical leg 150 of each side frame angle 146 and the end plate 148 have apertures 151. These apertures 151 allow the end plates 148 to be connected to the conveyor body lower ends 90 and the side frame angle vertical legs 150 be connected to the sheet inner and outer connecting chute segments 44, 55 by fasteners 152.

Each side frame angle 146 has a horizontal leg 153 which extends out from and beyond the vertical leg 150 to hold therebetween a horizontal leg 154 of an outer end frame angle 156. Attached to the horizontal leg 154 is a centrally located attaching plate 157 having an aperture (not shown). A vertical leg 158 of the outer end frame angle 156 connects with one of the end plates 148. Also extending between the vertical legs 150 of the side frame angles 146 is an upper frame bar 160 which in turn connects with the other end plate 148. Positioned below the upper frame bar 160 is a vertical leg 162 of a lower frame angle 164. The upper frame bar 160 and the lower frame angle vertical leg 162 are spaced apart to form a narrow, elongated horizontal opening 166.

Attached to an inner portion of a horizontal leg 168 of the lower frame angle 164 is a latch plate 170. The latch plate 170 has a center platform segment 172 with a threaded aperture to receive a bolt and included washer 174. A chute portion sanitary plate 178 having inner and outer end attaching tabs 180, 182 may be positioned over a lower end 183 of the chute portion 142. The outer tab 182 has an aperture aligned with the aperture in the attaching plate 157 to receive a bolt-nut assembly 184. The inner tab 180 on the sanitary plate 178 is formed with a laterally positioned cutout to fit about and be assembled to the bolt-washer assembly 174.

The drive portion 144 of the gate assembly 140 includes an inner end wall plate 190 having an upper angularly offset flange 192 for attachment to the bottom wall 84 of the conveyor body 82. A lower flange 194 of the end wall plate 190 has a centrally located aperture for a further bolt-nut assembly 196. To add stiffness to the end plate 190 two spaced gussets 198 are attached to the plate 190 between the flanges 192, 194.

Attached to the end wall plate 190 on a side opposite the lower flange 194 is a support angle 200. Sides of the angle 200 are inwardly recessed from side edges 202 of the end wall plate 190 providing space for a pair of spaced apart drive portion slide bars 204. The slide bars 204 extend forward and terminate adjacent to the assembly chute portion 142. Aligned with the drive portion slide bars 204 is a further pair of chute portion slide bars 205. Outer ends 206 of the slide bars 205 abut the vertical leg 158 of the outer end frame angle 156. Positioned laterally between outer ends 206 of the slide bars 205 is an outer end slide bar 208.

Upper surfaces 210 of the bars 204, 205 and 208 are aligned to form a support for a door plate 214. The door plate 214 extends through the opening 166 where an inner end 216 of the plate 214 at its center connects with a rack 218. The rack 218 in turn extends toward the inner end wall plate 190. With the door plate 214 advanced to be in contact with the slide bar 208, an inner end portion 220 of the rack 218 is supported on a rack support bar 222. The bar 222 is positioned between the drive portion slide bars 204 and connected thereto.

The rack 218 operatively engages a pinion gear 224 affixed to a shaft 228. Attached to one shaft end 229 is a bushing 230 journaled in one of a pair of bearings 232. The bearings 232 are affixed one each to spaced apart drive portion side cover plates 234. The bushing 230 has an outer enlarged portion 236 to limit lateral movement of the shaft 228. Attached to an opposite end 237 of the shaft 228 is a handle 238 having a hub portion 240 journaled in the other bearing 232.

Each side cover plate 234 is formed with an end flange 242 for attachment to the inner end wall plate 190 by bolt-nut assemblies 244. The side cover plates 234 each have a trianglular-like shape such that an upper edge 246 of each abuts the conveyor body sidewalls 86. Narrowed outer ends 248 of the side cover plates 234 are supported on the horizontal legs 153 of the side frame angles 146 with a bottom edge of each plate 234 proximately aligned with a bottom of the slide bars 204. Positioned over the bottom edges of the two side cover plates 234 is a drive portion sanitary plate 252. Inner and outer end attaching tabs 254, 256 extend from end edges 258 of the plate 252. The inner tab 254 is apertured to receive bolt-nut assembly 196 while the outer tab 256 has a laterally positioned cutout to allow for rotational assembly with the bolt-washer assembly 174.

To isolate the chute portion 142 from the drive portion 144, an upper and lower seal bar 260, 262 engage an upper surface 264 and lower surface 266 of the door plate 214. The preferred seal has a carpeted exterior. The upper seal 260 is held in position by an inverted L-shaped seal cover 268 attached to the upper frame bar 160. The lower seal 262 is held by a further L-shaped seal cover 269 which in turn is attached to the lower frame angle 164. Note that the upper and lower seals 260, 262 extend fully across the door plate surface 264, 266 and align with cutout openings 270 formed in the vertical legs 150 of the side frame angles 146. The cutout openings 270 are each covered by a seal plate 272 which in turn is held in place by stud-nut assemblies 274 where the stud portions are affixed to the side frame angle vertical legs 150 respectively. On each seal plate 272 is a side seal 273 having a carpeted texture. These side seals 273 project through the openings 270 to engage sides 277 of the door plate 214.

As seen in FIGS. 8 and 9, the door plate 214 is in an advanced position to close a passageway 275 through the assembly chute portion 142. As located, a forward edge 276 of the door plate 214 abuts the vertical leg 158 of the outer end frame angle 156 while the lower surface 266 of the door plate 214 is held against the upper surface 210 of the outer end slide bar 208 by a forward holddown angle 278. The angle 278 is attached to the outer end frame angle vertical leg 158 and is inverted to have two downward facing chamfered edges 280. Attached to each vertical leg 150 of the side frame angles 146 at the joinder with the upper frame bar 160 is a rear close off plate 282. These close off plates 282 are positioned just above the upper surface 264 of the door plate 214.

It should be understood it is most desirable to maintain the inner space 22 of the hopper car body 12 free from outside contamination whether the body 12 is full of commodity or empty and waiting to be filled. To aid in maintaining the inner space 22 contamination-free all connections between structural elements are closely fitted and sealed as required. Such sealing may be accomplished by using weld joints or applying a sealant as identified above. Recognizing further that over time, the car interior space 22 may become contaminated, it is also most important that the various surfaces defining the inner space 22 and appurtenances such as the chute discharge assembly 140 may be readily cleaned.

Assuming that the car body 12 is in a clean condition to receive a dry granular or powdered commodity, the assembly door plate 214 would be advanced to close the passageway 275 of each assembly chute portion 142. Additionally, the sanitary plates 178, 252 would be secured in place as seen in FIG. 9. Upon being filled the hopper car 10 then would be transported to a remote location for delivery of the commodity. During transit the weight of the commodity on the door plate 214 helps to seal the plate lower surface 266 against the upper surface 210 of the slide bars 205, 208.

It should be understood that the sequence of unloading the car body compartments 26, 28 will depend upon the unloading facilities at the delivery location. In the description below, it is assumed that only one chamber of one compartment, for example, the end chamber 26 as seen in FIG. 5 is being unloaded. In practice unloading would not necessarily be so limited.

Unloading begins by loosening the bolt-washer assembly 174 and the bolt-nut assembly 184, allowing rotation of the sanitary plate 178 to a position to uncover the lower end 183 of the assembly chute portion passageway 275. Next the assembly handle 238 is rotated counterclockwise so that the pinion gear 224 engages the rack 218 to retract the door plate 214 to open the passageway 275.

Rotation of the gear 224 retracts the door plate 214 through the opening 166 so that the plate surfaces 264, 266 and sides 277 slide against the seals 260, 262 and 273. During this movement the upper seal 260 provides a wiping action to remove commodity adhering to the plate upper surface 264. Inward movement of the door plate 214 is limited by stops 292 positioned one each of the slide bars 204 insuring continuous contact of the door plate 214 between the seals 260, 262 and 273. At the same time the lower seal 262 and side seals 273 wipe the plate lower surface 266 and sides 277 clean.

As seen in FIGS. 5 and 6, the air inlet couplings 126 of the conveyors 78 connect with air supply piping 290 carried by the hopper car 10. This piping 290 in turn may be selectively connected to an external air supply source at the location where the commodity is to be unloaded from the car body 12. With this connection made an air flow is delivered from the piping 290, through the conveyor couplings 126, and into the plenum 92 of each conveyor 78. The deflector plates 128 direct a substantial portion of this air flow towards the conveyor lower ends 90. The air then flows upward through the media support plates 110 and media sheets 112 to lift and aerate the commodity adjacent to the chute outlet 130. This commodity discharges through the outlet 130 to create a void space above the conveyor lower ends 90. Note that the door plate 214 may also be retracted after the air flow has commenced rather than before.

A lesser portion of the air supplied to the conveyor plenums 92 flows toward the conveyor upper ends 88. This lesser portion also flows upward through the conveyor media support plates 110 and media sheets 112 to aerate commodity immediately above the media sheets 112. This loosened commodity flows down the media sheets 112 and chamber inner and outer side sheets 36, 46 to come in contact with the more substantial air flow to enhance its discharge through the chute outlet 130. Under the influence of gravity upper portions of commodity fall to occupy the space created by the displaced commodity. Within a short time period the end compartment chamber 56 is emptied so that the air supply to the conveyors 78 may be shut off. The other chamber 56 of the end compartment 26 may then be emptied in a like manner.

Note that as commodity flows through the assembly chute passageway 275, the closeoff plates 282 and the seals 260, 262 and 273 inhibit commodity entering the assembly drive portion 144. Thus, if the hopper car 10 is subsequently used to transport a different commodity, previous commodity is not entrapped in the assembly drive portion 144 to mix with and possibly contaminate the subsequent commodity.

If the end compartment 26 and discharge assembly 140 require a thorough cleaning, the bolt-nut assembly 196 is loosened. This loosening allows the drive portion sanitary plate 252 to be rotated to provide access into the drive portion 144. The entire compartment 26 and assembly 140 then may be cleaned with an air blast or nozzle discharge of liquid. Additionally, removal of seal plates 272 provides access to the seals 260, 262 and 273. These seals 260, 262 and 273 then may be cleaned and replaced if required.

To prepare the empty compartment 26 and discharge assembly 140 for return and refilling, the assembly handle 238 is rotated clockwise to advance the door plate 214 to again close the passageway 275. Next, with the bolt-nut assemblies 184, 196 serving as pivots, the sanitary plates 178, 252 are rotated so that the cutout in each plate tab 180, 256 engages the bolt-washer assembly 174. The boltwasher assembly 174 and the bolt-nut assemblies 184, 196 then may be tightened to secure the sanitary plates 178, 252. During subsequent movement of the hopper car 10 in an empty condition, the holddown 278, and seals 260, 262 and 273 inhibit ambient contamination which inadvertently might have bypassed the sanitary plates 178, 252 from entering the compartment 26.

While an embodiment of this invention has been shown and described, it should be understood that the invention is not limited hereto except by the scope of the claims. Various modifications and changes can be made without departing from the scope and spirit of the invention as the same will be understood by those skilled in the art.

What we claim is:

1. A railroad hopper car having self-contained means to enhance an unloading of commodity shipped in said car with said means providing resistance to an intermingling of said commodity with outside contaminants during shipment and unloading, said means including a slide gate discharge assembly comprising:

chute portion connectable to conveyor ends in a body of said car to define in part a chute outlet, said chute portion including spaced apart side frame angles connecting with end plates, an inner and outer frame angle connecting with said end plates to pivotally hold a first sanitary plate rotatable to cover or uncover a lower end of a passageway through said chute portion and a moveable door plate carried by slide bars attached to said side and outer end frame angles to form a further selective closure of said passageway; and a drive portion connecting with said chute portion, said drive portion having an inner end wall plate prepared to connect with said conveyor, a pair of spaced apart slide bars attached to said end wall plate and positioned to align with said chute portion slide bars to receive said door plate upon retraction by operative means, said operative means having a rack attached to said door plate and extending into said drive portion, said door plate to be carried on a support bar attached to said slide bars whereby said rack is contained within the drive portion irrespective of the position of said door plate, a pinion gear in operative engagement with said rack with said pinion affixed to a shaft having ends journaled in side cover plates, said side cover plates connecting with said drive portion end wall plate, a handle attached to an end of said shaft exterior of said side cover plate for selective rotation of said shaft and affixed pinion to move said rack and attached door cover plate, upper, lower and side seals carried in said drive portion to continuously engage an upper and lower surface and sides of said door plate to isolate said drive portion from said chute portion whereby no commodity can seep therebetween, a drive portion sanitary plate pivotally carried by said inner end wall plate and side cover plates, said drive portion cooperates with the bottom wall of the conveyor body to form an enclosure whereby said door plate is not subject to environmental contaminants when said door plate is within said drive portion, wherein retraction of said door plate and selective positioning of said first sanitary plate opens said passageway for ready unloading of said commodity with said commodity maintained separate and apart from said assembly drive portion in part of by said seals.

2. A railroad car self-contained unloading means as defined by claim 1 and further characterized by, vertical legs of said side frame angles each formed with a cutout aligned with said upper and lower seals with said seals held against said door plate surfaces by covers attached to an upper frame bar and said inner end frame angle respectively, and removable plates each with one said side seal with said plates positioned over said cutouts allowing selective access to said upper and lower seals.

3. A railroad car self-contained unloading means as defined by claim 1 and further characterized by, a forward holddown angle attached to said outer end frame angle and extending into said assembly passageway, said angle having chamfered edges to engage said door plate as said door plate advances to close said passageway and press said door plate against said slide bars, rear close off plates attached one each to said side frame angles to limit commodity contract with said seals, and stops attached to said drive portion slide bars to limit retraction of said door plate and maintain contact between said seals and said door plate.

* * * * *